US009562276B2

(12) United States Patent
DiDomizio et al.

(10) Patent No.: US 9,562,276 B2
(45) Date of Patent: Feb. 7, 2017

(54) NICKEL ALLOY AND ARTICLES

(71) Applicant: General Electric Company, Schenectady, NY (US)

(72) Inventors: Richard DiDomizio, Charlton, NY (US); Judson Sloan Marte, Troy, NY (US); Pazhayannur Ramanathan Subramanian, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 437 days.

(21) Appl. No.: 14/105,550

(22) Filed: Dec. 13, 2013

(65) Prior Publication Data

US 2014/0154094 A1 Jun. 5, 2014

Related U.S. Application Data

(62) Division of application No. 12/844,277, filed on Jul. 27, 2010, now Pat. No. 8,608,877.

(51) Int. Cl.

| | |
|---|---|
| ***C22C 19/05*** | (2006.01) |
| ***C22F 1/10*** | (2006.01) |
| ***C22C 19/03*** | (2006.01) |
| ***C22C 19/07*** | (2006.01) |

(52) U.S. Cl.

CPC ..... *C22C 19/056* (2013.01); *C22C 19/03* (2013.01); *C22C 19/05* (2013.01); *C22C 19/07* (2013.01); *C22F 1/10* (2013.01)

(58) Field of Classification Search

CPC ..... C22F 1/10; C22C 19/03; C22C 19/056
See application file for complete search history.

(56) References Cited

U.S. PATENT DOCUMENTS

| | | | | |
|---|---|---|---|---|
| 3,519,419 A | | 7/1970 | Gibson | |
| 3,660,177 A | | 5/1972 | Brown | |
| 3,871,928 A | | 3/1975 | Smith | |
| 4,209,348 A | | 6/1980 | Duhl | |
| 5,080,734 A | * | 1/1992 | Krueger | C22F 1/10 148/410 |
| 5,759,305 A | * | 6/1998 | Benz | C22F 1/10 148/514 |
| 5,904,062 A | | 5/1999 | Semiatin | |
| 6,521,175 B1 | | 2/2003 | Mourer | |
| 7,208,116 B2 | | 4/2007 | Manning | |
| 2004/0221925 A1 | | 11/2004 | Tamaki | |
| 2005/0072500 A1 | | 4/2005 | Cao | |

FOREIGN PATENT DOCUMENTS

| | | |
|---|---|---|
| EP | 1605074 A1 | 12/2005 |
| EP | 2236635 A1 | 10/2010 |
| EP | 2256222 A1 | 12/2010 |
| JP | 60013020 A | 1/1985 |
| JP | 60255948 A | 12/1985 |

OTHER PUBLICATIONS

Search Report and Written Opinion from corresponding EP application 11175014.7-1215 dated Mar 12, 2012.
Search Report from corresponding EP application 11175014.7-1215 dated Nov. 30, 2011.
Song et al., "Grain Growth and Particle Pinning in a Model Ni-based Superalloy", Materials Science and Engineering, A,, vol. 479, pp. 365-372, 2008.
Sims et al., Superalloys II, John Wiley and Sons, NY, pp. 110-111 and 178-180, (1987).

* cited by examiner

*Primary Examiner* — Jessee Roe
(74) *Attorney, Agent, or Firm* — Paul J. DiConza

(57) ABSTRACT

Articles suitable for use in high temperature applications, such as turbomachinery components, and methods for making such articles, are provided. One embodiment is an article. The article comprises a material comprising a plurality of L12-structured gamma-prime phase precipitates distributed within a matrix phase at a concentration of at least 20% by volume, wherein the gamma-prime phase precipitates are less than 1 micrometer in size, and a plurality of A3-structured eta phase precipitates distributed within the matrix phase at a concentration in the range from about 1% to about 25% by volume. The solvus temperature of the eta phase is higher than the solvus temperature of the gamma-prime phase. Moreover, the material has a median grain size less than 10 micrometers.

19 Claims, No Drawings

NICKEL ALLOY AND ARTICLES

This application is a divisional of U.S. Ser. No. 12/844,277, now U.S. Pat. No. 8,608,877, filed Jul. 27, 2010 herein incorporated by reference in its entirety.

BACKGROUND

This invention relates to high-temperature materials. More particularly, this invention relates to metal alloys and articles for high-temperature service, and to methods for making such alloys and articles.

The remarkable strength of many superalloys is primarily attributable to the presence of a controlled dispersion of one or more hard precipitate phases within a comparatively more ductile matrix phase. For instance, many nickel-based superalloys are primarily strengthened by an intermetallic compound known as "gamma-prime." In general, articles formed from these alloys are processed to achieve a target grain size, then heat treated to achieve a dispersion of gamma-prime precipitates having desired size and morphology to provide the balance of properties specified for the material. This heat treatment typically involves at least three phases. First, the material is given a "solutionizing" heat treatment above the gamma-prime solvus temperature to dissolve any gamma-prime that may have formed during solidification and/or other prior processes (referred to as "primary gamma-prime"). Then the material is cooled either very rapidly, or in a controlled manner, to allow precipitation of gamma-prime of a desired size and shape. Finally, if needed, the material is subsequently given another heat treatment, called an "aging" treatment, at a temperature below the gamma-prime solvus, to allow the gamma-prime to precipitate to the degree specified for the given application. Multiple cooling and aging steps may be used to effect precipitation of gamma-prime having various sizes and shapes. The material is then processed to final dimensions via various known forming and machining methods.

The grain size of the alloy is another micro structural feature that plays a measurable role in determining some properties of the material. As the material is heated to high temperatures, the grains in the material are energetically favored to grow. However, in some applications, the grain size is desired to be quite small, and thus controlling grain size during thermal processing is an important consideration. In alloys where gamma-prime is the primary precipitate phase in the microstructure, maintaining a desirable grain size can be problematic when gamma-prime is completely or nearly completely dissolved during the "solutionizing" heat treatment, because gamma-prime is the primary grain size controlling phase in the material due to its ability to pin grain boundaries to inhibit growth. With no gamma-prime in the microstructure, and at elevated temperature, grain growth can occur because there are substantially no other phases present in the microstructure to prevent growth. To address this issue, heat treatment processes have been developed wherein a certain amount of primary gamma-prime is allowed to remain undissolved during heat treatment, leaving the primary gamma-prime to perform a grain boundary pinning function during heat treatment. As a result, the gamma-prime distribution in the processed part will include not only the fine dispersion of gamma-prime generated during the aging step(s), but also a population of typically coarser primary gamma-prime that is generally not as effective in contributing strength to the material. On the other hand, processes that dissolve substantially all of the primary gamma prime may result in an overall finer dispersion of gamma prime, but generally result in material having a coarser grain size than is desirable for certain applications.

Therefore, there remains a need in the art for materials and methods that allow for the combination of fine grain size with fine dispersions of gamma-prime phase to optimize the properties of articles used in high temperature applications, such as turbomachinery components.

BRIEF DESCRIPTION

Embodiments of the present invention are provided to meet these and other needs. One embodiment is an article, such as a component for use in turbomachinery. The article comprises a material comprising a plurality of L12-structured ordered gamma-prime phase precipitates distributed within a matrix phase at a concentration of at least 20% by volume, wherein the gamma-prime phase precipitates are less than 1 micrometer in size, and a plurality of A3-structured ordered eta phase precipitates distributed within the matrix phase at a concentration in the range from about 1% to about 25% by volume. The solvus temperature of the eta phase is higher than the solvus temperature of the gamma-prime phase. Moreover, the material has a median grain size less than 10 micrometers.

Another embodiment is an article that comprises a material, where the material comprises, in weight percent, at least about 40% nickel, from about 3% to about 6% titanium, from about 4% to about 6% tantalum, from about 2% to about 3.5% aluminum, from about 11.5% to about 13% chromium, from about 16% to about 20% cobalt, from about 0.03% to about 0.1% carbon, from about 0.02% to about 0.08% zirconium, from about 1% to about 4% molybdenum, from about 0.75% to about 1.25% niobium, from about 2% to about 5% tungsten, and from about 0.1% to about 0.6% hafnium. The weight ratio of titanium to aluminum is in the range from about 1 to about 4. The material further comprises, as described above, gamma-prime precipitates at a concentration of at least 20% by volume and with a size less than 1 micrometer, and eta phase precipitates, where the solvus temperature of the eta phase is higher than the solvus temperature of the gamma-prime phase. Moreover, the material has a median grain size less than 3 micrometers, the eta phase precipitates have a median size less than about five times the grain size of the material.

Another embodiment is a method for forming an article. The method comprises providing a workpiece, the workpiece comprising the following elements, in weight percent: at least about 40% nickel, from about 1.5% to about 8% titanium, and from about 1.5% to about 4.5% aluminum. A weight ratio of titanium to aluminum is in the range from about 1 to about 4, and the workpiece further comprises a plurality of A3-structured ordered eta phase precipitates distributed within the matrix phase at a concentration in the range from about 1% to about 25% by volume. The method further comprises mechanically working the workpiece at a temperature below a solvus temperature of the eta phase; and heat treating the workpiece at a temperature sufficiently high to dissolve any gamma prime phase present in the workpiece but below the solvus temperature of the eta phase.

DETAILED DESCRIPTION

According to one embodiment of the present invention, an article is provided. The article comprises a material engineered to preserve a fine grain size during processing through the presence of a high-temperature phase (a "pinning phase") that is different from the primary strengthening phase of the material. This pinning phase remains present during processing, thereby pinning the grain boundaries to inhibit deleterious growth as the material receives various high temperature treatments, such as heat treatments to dissolve strengthening precipitate phases. As a result, the material can be produced with a desired grain size and a desired precipitate strengthening phase size and morphology for various applications where high performance at elevated temperatures is desirable. Examples of such articles in accordance with embodiments of the present invention include components, both rotating and stationary, used in gas turbine assemblies, including land-based gas turbine assemblies and jet engines; non-limiting examples of such components include disks, wheels, vanes, blades, shrouds, compressor components, and combustor components. Other examples include components used in the oil and gas industry, such as risers and other structural components, pumps, fittings, and valves.

The material of the article is formulated and processed to provide certain desired microstructural constituent phases while maintaining a grain size less than 10 micrometers. In certain embodiments, the grain size is less than about 3 micrometers, and in particular embodiments the grain size is less than about 1 micrometer. A comparatively fine grain size may be desirable to enhance the strength of the material, but the ultimate selection of grain size depends on the desired balance of properties for a given application. For instance, fine grain size may provide strength but may be detrimental to creep resistance where the stress and temperature of a given application implicates such properties.

The material comprises an $L1_2$-structured ordered gamma-prime phase having the general formula $X_3M$, where X comprises nickel and M comprises aluminum. Those skilled in the art will appreciate that other elements may be present in the gamma-prime phase as well. For example, X may also include cobalt, chromium, molybdenum, or tungsten, while M may further include titanium, niobium, tantalum, or vanadium. These lists are not intended to be exhaustive, and combinations of these elements may be present.

The gamma-prime phase is the primary strengthening phase in the material, and is present in the material at a concentration of at least 20% by volume. In some embodiments the concentration is at least 30% by volume and in particular embodiments the concentration is at least 35% by volume. Gamma-prime phase generally exists in the material as a plurality of precipitates distributed within a matrix phase as commonly observed in nickel-based superalloys. In the article described herein, the gamma-prime precipitates are less than 1 micrometer in size.

This combination of a fine grain size with a fine dispersion of gamma-prime of the type described above has been difficult, if not impossible, to achieve using conventional materials. To achieve a gamma-prime dispersion in which the precipitates are less than 1 micrometer, the material is heat treated above the gamma-prime solvus temperature to dissolve all of the so-called "primary gamma-prime"—the gamma-prime present from melting operation and initial thermomechanical processing operations. The gamma-prime then can be carefully precipitated into the matrix phase in a controlled manner well known in the art to achieve the desired size distribution and morphology. However, when the gamma-prime is dissolved in a conventional material, the grain size of the material rapidly grows because there is little or no phase present to pin the boundaries and inhibit grain growth. As a result, conventional gamma-prime strengthened materials having fine grain sizes generally contain some fraction of comparatively coarse, primary gamma-prime precipitates because they are not processed to dissolve the gamma-prime completely in an effort to control grain size to some degree.

In sharp contrast, the material described herein contains an additional phase that persists at temperatures above the gamma-prime solvus and provides grain boundary pinning even when substantially all of the primary gamma-prime is dissolved, thus providing the opportunity to achieve unprecedented combinations of fine gamma-prime dispersions and fine grain size. In particular, the material of the article includes an A3-structured ordered intermetallic phase, known in the art as the "eta phase" or simply "η." Eta phase as present in the material described herein has the generic formula $A_3B$, wherein A comprises nickel, and B comprises titanium. Those skilled in the art will appreciate that other elements may be present in the eta phase as well. For example, A may also include cobalt, chromium, molybdenum, or tungsten, while B may further include niobium, tantalum, or aluminum. These lists are not intended to be exhaustive, and combinations of these elements may be present.

The material is formulated to provide eta phase at a concentration effective to produce the desired effect of inhibiting grain growth during heat treatment as described above. In some embodiments, the concentration is in the range from about 1% to about 25% by volume of the material. In certain embodiments, the concentration is in the range from about 3% to about 15% by volume, and in particular embodiments the concentration is in the range from about 5% to about 10% by volume. Generally, selecting the concentration of eta phase in the material includes a consideration of the balance between the pinning effect provided by the eta phase and any deleterious effects associated with the phase, such as a tendency to create stress concentrations (depending on the phase morphology) and its comparatively brittle nature. Indeed, in conventional nickel based alloys, eta phase is regarded as a phase to be minimized or eliminated from the microstructure. C. Sims, M. Stoloff, W. Hagel. *Superalloys II* John Wiley and Sons, NY, 1987, pp 257-258. In stark contrast, the material of the present invention seeks to include eta phase to help control grain size. By processing the material as described herein, the eta phase may be controlled in size and morphology to minimize deleterious effects on mechanical properties of the material.

The solvus temperature of the eta phase, that is, the temperature at which the eta phase is completely dissolved in the material, is higher than a solvus temperature of the gamma-prime phase. In short, the chemistry of the material is selected such that the eta phase will be present in the material even after the gamma prime phase has dissolved, such as during a heat treatment above the gamma prime solvus temperature. Thus the material may be solution-treated above the gamma-prime solvus temperature, then cooled and further processed to achieve the desired balance of properties attributable to gamma prime size, distribution, and morphology, all while maintaining the grain size at desirable levels. In some embodiments, the eta phase solvus temperature is above 1100 degrees Celsius, while in particular embodiments, the eta phase solvus temperature is above 1200 degrees Celsius, and in particular embodiments it is above 1250 degrees Celsius. A comparatively high eta phase solvus temperature, relative to the gamma prime solvus temperature, is desirable to maximize the amount of eta present after the gamma prime has dissolved.

The size and morphology of the eta phase may play a role in how effectively the eta phase inhibits grain growth. Eta phase may be present in one or more shapes, including spherical or lenticular shapes, needles, plates, and other shapes. In some embodiments, the eta phase comprises a plurality of precipitates having a mean aspect ratio less than 30. In some embodiments, a lower aspect ratio is applied, such as less than 15, and in particular embodiments less than 10. The size of the eta phase precipitates is typically correlated with the desired grain size of the material. For example, in some embodiments, the eta phase precipitates have a median size less than about five times the grain size of the polycrystalline material. In certain embodiments, the mean size of the eta phase precipitates is less than about three times the grain size, and in particular embodiments the mean size of the eta phase precipitates is less than about two times the grain size. Eta phase size and morphology, and indeed grain size of the material, are controlled by a number of factors, including the amount of deformation introduced into the material during processing, as will be described in more detail, below.

In some embodiments, the material described above includes the following elements, with concentrations in weight percent (%):

at least about 40% nickel;

titanium—generally from about from about 1.5% to about 8%, in some embodiments from about 2% to about 7%, and in particular embodiments from about 3% to about 6%; and aluminum—generally from about 1.5% to about 4.5%, in some embodiments from about 2% to about 4%, and in particular embodiments from about 2% to about 3.5%.

This composition shall be referred to herein as "Composition A."

The composition is further controlled to maintain a weight ratio of titanium to aluminum. In some embodiments, this ratio is in the range from about 1 to about 4, while in certain embodiments the ratio is in the range from about 1.25 to about 3, and about 1.5 to 2.5 in particular embodiments. Maintaining the ratio in the given range helps to maintain the proper balance of constituent gamma-prime and eta phases.

In general, the elements present in the material of the present invention perform similarly relative to their functions in conventional superalloys. In some embodiments, the material comprises additional elements commonly used in conventional superalloys. Thus the material, in some embodiments, may further comprise one or more of the following:

tantalum—from about 2% to about 8%, in some embodiments from about 3% to about 7%, and in particular embodiments from about 4% to about 6%;

chromium—from about 11.5% to about 15%, in some embodiments to about 14%, and in particular embodiments to about 13%;

cobalt—from about 15% to about 30%, in some embodiments from about 15% to about 25%, and in particular embodiments from about 16% to about 20%;

carbon—from about 0.02% to about 0.2%, in some embodiments from about 0.02% to about 0.1%, and in particular embodiments from about 0.03% to about 0.1%;

boron—from about 0.01% to about 0.05%;

zirconium—from about 0.02% to about 0.1%, in some embodiments from about 0.02% to about 0.09%, and in particular embodiments from about 0.02% to about 0.08%;

molybdenum—up to about 7%, in some embodiments from about 1% to about 5%, and in particular embodiments from about 1% to about 4%;

niobium—up to about 2%, in some embodiments from about 0.5% to about 1.5%, and in particular embodiments from about 0.75% to about 1.25%;

hafnium—up to about 1%, in some embodiments from about 0.1% to about 0.8%, and in particular embodiments from about 0.1% to about 0.6%.

To take advantage of some of the properties described herein, the following example material compositions are provided, but these should not be construed as limiting the description of the material as provided above, where elements and their concentrations may be independently selected at any of the levels described. One example is an article where the material of the article comprises (in weight percent): from about 2% to about 7% titanium, from about 3% to about 7% tantalum, from about 2% to about 4% aluminum, from about 11.5% to about 14% chromium, from about 15% to about 25% cobalt, from about 0.02% to about 0.1% carbon, from about 0.02% to about 0.09% zirconium, from about 1% to about 5% molybdenum, from about 0.5% to about 1.5% niobium, from about 1% to about 5% tungsten, and from about 0.1% to about 0.8% hafnium. The balance of the composition comprises nickel at a level of at least about 40%. The weight ratio of titanium to aluminum is any of those described above, as is the presence and concentration of eta phase and gamma prime phase. Similarly, in another example of the composition for the material described above, the material comprises from about 3% to about 6% titanium, from about 4% to about 6% tantalum, from about 2% to about 3.5% aluminum, from about 11.5% to about 13% chromium, from about 16% to about 20% cobalt, from about 0.03% to about 0.1% carbon, from about 0.02% to about 0.08% zirconium, from about 1% to about 4% molybdenum, from about 0.75% to about 1.25% niobium, from about 2% to about 5% tungsten, and from about 0.1% to about 0.6% hafnium. The balance of the composition comprises nickel at a level of at least about 40%. This particular composition is referred to as "Composition B" below. The weight ratio of titanium to aluminum is any of those described above, as is the presence and concentration of eta phase and gamma prime phase.

In one particular embodiment, an article is provided. The article comprises a material comprising Composition B, with a weight ratio of titanium to aluminum in the range from about 1 to about 4. The material further comprises fine (less than 1 micrometer) gamma-prime phase, and eta phase, as described previously. The material grain size is 3 micrometers and the eta phase precipitates have a median size less than about five times the grain size of the material. Again, such a combination of fine gamma-prime and fine grain size is generally unavailable in convention materials of this type and is enabled by the presence of the persistent eta phase.

Another embodiment is a method for making the article described above. In this method, a workpiece comprising Composition A (described previously) is provided, such as by casting processes, cast and wrought processing, or by powder metallurgy processing, and is mechanically worked at a temperature below the eta phase solvus temperature. This working step introduces strain into the microstructure to refine the grain size to a desired level, in accordance with mechanisms and processes known in the art. In some embodiments, the working step includes the use of a Severe Plastic Deformation (SPD) process, such as multi-axis forging, equal channel angular extrusion, twist extrusion, high-pressure torsion, or accumulative roll bonding, as non-limiting examples. Generally, SPD is defined to include any process that introduces providing very large deformations (such as greater than 225% true strain) at relatively low temperatures under high pressures. See, for example, R. Z. Valiev, R. K. Islamgaliev, and I. V. Alexandrov, "Bulk Nanostructured Materials from Severe Plastic Deformation", Prog. Mater. Sci., Vol. 45, 2000, p. 104. SPD may be used to introduce large amounts of deformation into the material, thereby providing a driving force for the formation of very fine grains, including grains having the sizes described above for the material. In some embodiments, the working step includes conventional processing technology aside from or in addition to the SPD processes; examples of these conventional processes include extruding, forging, and rolling. In some embodiments, the working step includes introducing a total true strain into the workpiece of at least about 225%; in particular embodiments the amount of true strain is at least about 300%, and in certain embodiments the amount of true strain is at least about 600%.

The workpiece is then heat treated at a temperature sufficiently high to dissolve substantially any primary gamma prime phase present in the material, but below the solvus temperature of the eta phase so that eta phase remains in the microstructure to control the grain size to a desired level, such as the levels described previously for the material.

The workpiece, in some embodiments, having been heat treated to dissolve substantially all of the primary gamma prime phase, is later heat treated again, this time to precipitate gamma prime phase in a controlled manner to achieve a desired size, morphology, and distribution. This heat treatment is performed below the gamma prime solvus temperature, which is typically in the range from about 1050 degrees Celsius to 1250 degrees Celsius. Gamma prime formed during this stage, in some embodiments, is referred to as "secondary gamma prime." Those skilled in the art will appreciate that secondary gamma prime may also form during cooling from the solution treatment if the cooling occurs at a rate that is compatible with the kinetics of gamma prime nucleation and growth, and thus by controlling cooling rates a desired secondary gamma prime dispersion may be developed as well. Other thermal treatments may be applied to form subsequent "generations" of gamma prime, often having a different size or morphology than the secondary gamma prime to enhance the properties of the material. For example, a subsequent thermal aging treatment may be performed to form a subsequent generation of gamma prime, called "tertiary gamma prime," which may have a desired size that is different from the secondary gamma prime phases. This aging treatment is performed at a combination of time and temperature selected to produce gamma prime precipitates having the desired characteristics. These parameters and their effects on precipitate size and morphology are well known to practitioners in the art.

Using the above method, along with known methods to fabricate the processed material to final configuration, an article, such as a component for a turbine assembly, may be fabricated with a unique combination of grain size below 10 micrometers and gamma prime precipitates below 1 micrometer. In some embodiments, the material is substantially free of primary gamma-prime, meaning that there is no more than about 1% by volume of primary gamma-prime in the material.

EXAMPLE

The following example is provided to further illustrate particular embodiments described above and should not be construed as limiting the invention.

A material was formed via known powder metallurgy methods; the material had the following approximate composition, in weight percent: nickel—50.2%, aluminum—3.0%, boron—0.03%, carbon—0.05%, cobalt—18.0%, chromium—12.0%, hafnium—0.4%, molybdenum—1.5%, niobium—1.0%, tantalum—4.8%, titanium—4.5%, tungsten—4.5%, zirconium—0.05%. The material was determined to contain eta phase at about 8.5% by volume, and to have a gamma-prime solvus temperature in the range from 1177 degrees Celsius to 1191 degrees Celsius. The material was heat treated above the gamma-prime solvus temperature and the grain size after heat treatment was measured to be about 8 micrometers. In contrast, a number of alloys that did not contain eta phase were similarly processed, and no such alloy in the study had a grain size below 13 micrometers, thus demonstrating the effectiveness of the eta phase in maintaining a fine grain size.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An article comprising: a material comprising the following elements, in weight percent:

at least about 40% nickel, from about 1.5% to about 8% titanium, and from about 1.5% to about 4.5% aluminum, wherein a weight ratio of titanium to aluminum is in the range from about 1 to about 4, a plurality of $L1_2$-structured ordered gamma-prime phase precipitates distributed within a matrix phase at a concentration of at least 20% by volume, wherein the gamma-prime phase precipitates are less than 1 micrometer in size, and a plurality of A3-structured ordered eta phase precipitates distributed within the matrix phase at a concentration in the range from about 3% to about 25% by volume, wherein a solvus temperature of the eta phase is higher than a solvus temperature of the gamma-prime phase, wherein the material further comprises from about 2% to about 8% tantalum, up to about 7% molybdenum, up to about 2% niobium, and up to about 1% hafnium and wherein the material has a median grain size of less than 3 micrometers.

2. The article of claim 1 wherein the eta phase solvus temperature is greater than about 1100 degrees Celsius.

3. The article of claim 1 wherein the concentration of eta phase is in the range from about 3% to about 15% by volume.

4. The article of claim 1 wherein the concentration of eta phase is in the range from about 5% to about 10% by volume.

5. The article of claim 1 wherein the plurality of eta phase precipitates have a mean aspect ratio less than about 30.

6. The article of claim 1 wherein the plurality of eta phase precipitates has a median size less than about five times the grain size of the material.

7. The article of claim 1 wherein the plurality of eta phase precipitates has a median size less than about three times the grain size of the material.

8. The article of claim 1 wherein the material has a median grain size of less than 1 micrometer.

9. The article of claim 1 wherein the ratio of titanium to aluminum is in the range from about 1.25 to about 3.

10. The article of claim 1 wherein the ratio of titanium to aluminum is in the range from about 1.5 to about 2.5.

11. The article of claim 1 wherein the material further comprises:

from about 11.5% to about 15% chromium,
from about 15% to about 30% cobalt,
from about 0.02% to about 0.2% carbon,
from about 0.01% to about 0.05% boron,
from about 0.02% to about 0.1% zirconium.

12. The article of claim 1 wherein the material comprises:

at least about 40% nickel,
from about 1.5% to about 8% titanium, and
from about 1.5% to about 4.5% aluminum,
wherein a weight ratio of titanium to aluminum is in the range from about 1 to about 4,
from about 4% to about 6% tantalum,
from about 11.5% to about 13% chromium,
from about 16% to about 20% cobalt,
from about 0.03% to about 0.1% carbon,
from about 0.02% to about 0.08% zirconium
from about 1% to about 4% molybdenum,
from about 0.75% to about 1.25% niobium,
from about 2% to about 5% tungsten, and
from about 0.1% to about 0.6% hafnium.

13. The article of claim 12 wherein the material comprises from about 3% to about 6% titanium and from about 2% to about 3.5% aluminum.

14. An article comprising: a material comprising, in weight percent, at least about 40% nickel,
from about 3% to about 6% titanium,
from about 4% to about 6% tantalum,
from about 2% to about 3.5% aluminum,
from about 11.5% to about 13% chromium,
from about 16% to about 20% cobalt,
from about 0.03% to about 0.1% carbon,
from about 0.02% to about 0.08% zirconium
from about 1% to about 4% molybdenum,
from about 0.75% to about 1.25% niobium,
from about 2% to about 5% tungsten, and
from about 0.1% to about 0.6% hafnium,
wherein a weight ratio of titanium to aluminum is in the range from about 1 to about 4;
wherein the material further comprises
a plurality of $L1_2$-structured ordered gamma-prime phase precipitates distributed within a matrix phase at a concentration of at least 20% by volume, wherein the gamma-prime phase precipitates are less than 1 micrometer in size, and
a plurality of A3-structured ordered eta phase precipitates distributed within the matrix phase at a concentration in the range from about 3% to about 25% by volume, wherein a solvus temperature of the eta phase is higher than a solvus temperature of the gamma-prime phase,
wherein the material has a median grain size less than 3 micrometers, and wherein the plurality of eta phase precipitates has a median size less than about five times the grain size of the material.

15. An article comprising: a material comprising the following elements, in weight percent:

at least about 40% nickel,
from about 6% to about 8% titanium, and
from about 1.5% to about 4.5% aluminum,
wherein a weight ratio of titanium to aluminum is in the range from about 1 to about 4,
a plurality of $L1_2$-structured ordered gamma-prime phase precipitates distributed within a matrix phase at a concentration of at least 20% by volume, wherein the gamma-prime phase precipitates are less than 1 micrometer in size, and
a plurality of A3-structured ordered eta phase precipitates distributed within the matrix phase at a concentration in the range from about 3% to about 25% by volume, wherein a solvus temperature of the eta phase is higher than a solvus temperature of the gamma-prime phase,
wherein the material has a median grain size less than 10 micrometers.

16. The article of claim 15 wherein the eta phase solvus temperature is greater than about 1100 degrees Celsius.

17. The article of claim 15 wherein the concentration of eta phase is in the range from about 5% to about 10% by volume.

18. The article of claim 15 wherein the material has a median grain size of less than 3 micrometers.

19. The article of claim 15 wherein the material has a median grain size of less than 1 micrometer.

* * * * *